US007011551B2

(12) United States Patent
Johansen et al.

(10) Patent No.: US 7,011,551 B2
(45) Date of Patent: Mar. 14, 2006

(54) ELECTRICAL TERMINAL BLOCK

(76) Inventors: Arnold W. Johansen, 226 Stow Rd., Marlboro, MA (US) 01752; Phillip Kimball, 4 Pleasant St., Norwell, MA (US) 02061; David Charles Nelson, 21 Ralph Rd., Princeton, MA (US) 01541

( * ) Notice: Subject to any disclaimer, the term of this patent is extended or adjusted under 35 U.S.C. 154(b) by 0 days.

(21) Appl. No.: 10/840,204

(22) Filed: May 6, 2004

(65) Prior Publication Data

US 2005/0250389 A1 Nov. 10, 2005

(51) Int. Cl.
*H01R 9/22* (2006.01)

(52) U.S. Cl. ..... 439/709; 439/723

(58) Field of Classification Search ..... 439/709, 439/711–712, 715–717, 723–724
See application file for complete search history.

(56) References Cited

U.S. PATENT DOCUMENTS

| | | | | |
|---|---|---|---|---|
| 3,604,876 A | | 9/1971 | Pasbrig | 200/275 |
| 3,781,724 A | | 12/1973 | Moore et al. | 333/182 |
| 3,963,296 A | * | 6/1976 | Glover et al. | 439/368 |
| 3,999,829 A | | 12/1976 | Glaesel | 439/437 |
| 4,145,107 A | | 3/1979 | De Haitre | 439/801 |
| 4,284,316 A | | 8/1981 | Debaigt | 439/342 |
| 4,514,025 A | | 4/1985 | Maulandi | 439/246 |
| 5,030,139 A | | 7/1991 | Huska | 439/513 |
| 5,380,226 A | | 1/1995 | Anderson | 439/724 |
| 5,411,417 A | | 5/1995 | Horn et al. | 439/709 |
| 5,437,003 A | * | 7/1995 | Blanco | 392/485 |
| 5,525,079 A | * | 6/1996 | Johnson | 439/709 |
| 5,641,312 A | | 6/1997 | Bippus et al. | 439/709 |
| 5,741,153 A | | 4/1998 | Schwer | 439/491 |
| 5,743,768 A | | 4/1998 | Hohorst et al. | 439/723 |
| 5,779,504 A | | 7/1998 | Dominiak et al. | 439/709 |
| 5,836,791 A | | 11/1998 | Waas et al. | 439/709 |
| 5,907,476 A | | 5/1999 | Davidsz | 361/732 |
| 6,093,041 A | | 7/2000 | Kay et al. | 439/225 |
| 6,224,429 B1 | | 5/2001 | Bernhards et al. | 439/709 |
| 6,884,090 B1 | * | 4/2005 | Kubota | 439/76.2 |
| 2001/0039132 A1 | | 11/2001 | Hanning et al. | |
| 2003/0148667 A1 | * | 8/2003 | Lias et al. | 439/709 |
| 2004/0048520 A1 | * | 3/2004 | Kobayashi | 439/709 |

* cited by examiner

*Primary Examiner*—Michael C. Zarroli
(74) *Attorney, Agent, or Firm*—Kriegsman & Kriegsman

(57) ABSTRACT

A terminal block for conductively coupling multiple pairs of electrical wires includes a deadfront cover mounted onto a non-conductive base so as to define multiple pairs of wire receiving receptacles, each pair of wire receiving receptacles being electrically connected together via a conductive bus bar. As one feature of the present invention, a conductive shunt can be disposed by means of a manually operable shunt switch to selectively contact all of the bus bars in order to discharge any current present thereon. As another feature of the present invention, a plurality of finger-safe captive screw assemblies are retained within the cover, each captive screw assembly including a screw which can be driven into a threaded bore formed in one end of a corresponding bus bar. As yet another feature of the present invention, multiple pairs of interchangeable end caps can be removably snap-fit mounted on the base to enable the terminal block to be retained onto a wide variety of different surfaces. As yet still another feature of the present invention, a DIN rail lock is retained between each end cap and the base and includes one or more sharpened teeth which can be driven into the surface of the DIN rail to lock the terminal block in place.

28 Claims, 14 Drawing Sheets

ELECTRICAL TERMINAL BLOCK

BACKGROUND OF THE INVENTION

The present invention relates generally to electrical connectors and more particularly to electrical terminal blocks for connecting wire pairs.

Electrical terminal blocks (also commonly referred to as terminal junction blocks, junction blocks, or barrier blocks) are well known and widely used in commerce as devices for safely, conveniently and efficiently connecting together one or more pairs of wires or cables. For example, electrical terminal blocks are commonly used in the telecommunications industry to provide convenient and compact means for connecting telephone customer service wires (i.e., the "service" side) to telephone exchange distribution cables (i.e., the "exchange" side). Specifically, an electrical terminal block used in the telecommunications industry typically includes a plurality (e.g., 4, 6, 8, 10, 12, 24, etc.) of interconnected terminal pairs which can be used to connect each individual distribution cable wire on the exchange side to a corresponding individual service wire on the service side.

One type of electrical terminal block (also referred to herein simply as a terminal block) which is well known and widely used in commerce includes a unitary, block-shaped base which is constructed out of an insulating material, such as plastic. The base is typically shaped to include a plurality of laterally disposed, equidistantly spaced partitions which extend orthogonally upward from its top surface. Furthermore, a plurality of parallel bus bars are laterally disposed across the top surface of the base, with one bus bar being disposed between each pair of successive partitions. Each bus bar is constructed of an electrically conductive material (e.g., nickel plated brass or nickel plated steel), wherein adjacent bus bars are electrically insulated from one another by the base partition positioned therebetween.

In use, a pair of wires are electrically connected together using a terminal block in the following manner. Specifically, a first wire (e.g., the service side wire) is electrically connected to one end of a bus bar by any number of different termination means (e.g., using a metal screw, metal eyelet or solder terminal). The second wire (e.g., the exchange side wire) is electrically connected to the opposite end of the same bus bar using any similar termination means. With each wire connected to the same conductive bus bar, an electrical path is established between the two wires, thereby effectively creating an electrical connection therebetween. As can be appreciated, additional wire pairs can be connected together in a similar manner using the unused bus bars on the terminal block to complete the necessary electrical connections between the service side wires and the exchange side wires. It should be noted that, in this manner, a terminal block serves as an organized, miniaturized and reliable means for connecting multiple pairs of electrical wires, which is highly desirable.

Having utilized a terminal block to complete the necessary connections between service side wires and exchange side wires, the terminal block, in turn, is often provided with means for securing the terminal block to a fixed object such as a support panel (e.g., a wooden panel on which a fuse box is mounted). In this manner, the terminal block can be positioned at a location which would minimize inadvertent contact.

Accordingly, terminal blocks of the type described above are typically provided with either panel mount means or Deutsche Industrie-Normen (DIN) rail mount means for retaining the terminal block onto a support panel. A panel mount terminal block is typically provided with a bore or slot at each end which enables the terminal block to be directly affixed onto a support panel using a conventional fastener (e.g., bolt or screw). A DIN rail mount terminal block is typically provided with means for snap-fitting the terminal block onto a metal bracket (i.e., a DIN rail) which, in turn, is affixed onto the support panel by screws.

Terminal blocks of the type described in detail above typically suffer from a few notable drawbacks.

As a first drawback, terminal blocks of the type described above are often used in commerce to actively electrically connect multiple (e.g., 10, 12 or 24) pairs of electrical wires. As a result, a considerable amount of electrical current often continuously passes through the bus bars of the terminal block. Accordingly, it has been found that electricians (or other suitable personnel) who frequently access the terminal block are susceptible to high (and often potentially fatal) levels of electrical shock because the terminal block is equipped with no means for temporarily shunting electrical charge present in the bus bars, which is highly undesirable.

As a second drawback, terminal blocks of the type described above are often provided with a plurality of laterally disposed parallel bus bars which are mounted on the top surface of the terminal block base in a substantially exposed manner. As a result, the top surface of each bus bar is rendered highly susceptible to inadvertent contact by any individual who works in the vicinity of the terminal block. As noted above, because each bus bar serves as a conductive path between a pair of wires, inadvertent contact with a bus bar can result in serious physical injury or death, which is highly undesirable.

As a third drawback, terminal blocks of the type described above are often provided with a plurality of ring lug receiving terminals, each terminal being designed so as to require a relatively time consuming and labor intensive process for connecting the ring lug of a wire thereto. Specifically, in order to couple a ring lug to such a terminal, a multiplicity of steps are required. First, a screw needs to be completely withdrawn (i.e., unscrewed) from a threaded bore formed in a bus bar. Second, the free end of the wire (or, in the alternative, a ring lug formed onto the free end of the wire) is disposed over the threaded bore in the bus bar. Third, while maintaining the wire in position against the bus bar, the metal screw is screwed back into the threaded bore so as to secure the wire in electrical connection with the bus bar. As can be appreciated, this three-step process for connecting each wire to an associated bus bar requires a considerable amount of manual dexterity and time, which is highly undesirable.

As a fourth drawback, terminal blocks of the type described above are typically manufactured with either panel mount or DIN mount capabilities. However, at the time of purchase, potential customers are often not readily aware which mounting type of terminal block will be required. Because conventional terminal blocks can not be readily converted between panel and DIN rail mount capabilities, the consumer often purchases a terminal block with the wrong type of mounting capability, which is highly undesirable.

As a fifth drawback, DIN rail mount terminal blocks of the type described above are typically designed to slide along the length of a DIN rail when snap-mounted thereon. Accordingly, after one or more DIN rail mount terminal blocks have been mounted onto a DIN rail, a pair of end pieces (i.e., bookends) are fixedly mounted on the DIN rail directly outside the terminal blocks. In this capacity, the end pieces preclude the one or more terminal blocks positioned therebetween from sliding along the DIN rail. Although useful in fixing the position of the one or more terminal blocks on the DIN rail, these types of end pieces are often somewhat bulky in size. As a result, the end pieces limit the number and/or size of terminal blocks which can be mounted along the length of a standard DIN rail, which is highly undesirable.

SUMMARY OF THE INVENTION

It is an object of the present invention to provide a new and improved terminal block for conductively coupling at least one pair of electrical wires.

It is another object of the present invention to provide a terminal block as described above which is designed to enable each electrical wire to be easily and safely conductively coupled thereto.

It is yet another object of the present invention to provide a terminal block as described above which is designed to prevent electrical shock.

It is still another object of the present invention to provide a terminal block as described above which is designed to be mounted on various types of surfaces.

It is yet still another object of the present invention to provide a terminal block as described above which can be mass produced, has a minimal number of parts, is modular in construction and can be easily assembled.

Accordingly, as one feature of the present invention, there is provided a terminal block for conductively coupling at least one pair of electrical wires, the terminal block comprising a non-conductive base, a first conductive bus bar mounted on the base, a second conductive bus bar mounted on the base in a spaced apart relationship from the first bus bar, and a conductive shunt adapted to be disposed into selective common contact with both of the first and second bus bars.

As another feature of the present invention, there is provided a terminal block for conductively coupling at least one pair of electrical wires, said terminal block comprising a non-conductive base, a conductive bus bar mounted on the base, the bus bar being shaped to define a threaded bore, and a cover assembly mounted on the base over the conductive bus bar, the cover assembly comprising a non-conductive cover comprising a top surface, the cover being shaped to define a bore, and a captive screw assembly retained within the bore in the cover.

As another feature of the present invention, there is provided a terminal block for conductively coupling at least one pair of electrical wires, the terminal block comprising a non-conductive base, a conductive bus bar mounted on the base, an end cap mounted on the base, the end cap being adapted to be mounted on a DIN rail, the end cap having an outer end wall, and a DIN rail lock disposed at a location inside of the outer end wall of the end cap, the DIN rail lock being adapted to selectively engage the DIN rail.

As another feature of the present invention, there is provided a terminal block for conductively coupling at least one pair of electrical wires, the terminal block comprising a non-conductive base shaped to include a mounting block, a conductive bus bar mounted on the base, and an end cap removably mounted on the mounting block.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 4(*b*) is an enlarged, front, bottom, right end perspective view of the base and bus bars shown in FIG. 2;

FIG. 5(*b*) is a section view of the terminal block shown in FIG. 1 taken along lines 5(*a*)—5(*a*), the captive screw assemblies and the bus bars shown therein being displayed in their entirety, the terminal block shown with the shunt disposed in electrical contact with each of the bus bars;

FIG. 6(*b*) is an enlarged, front, bottom, right end perspective view of the cover assembly shown in FIG. 2;

FIG. 8(*b*) is an enlarged, front, bottom, right end, partially exploded perspective view of the shunt carrier, springs, pins, shunt, shunt carrier and shuttle shown in FIG. 2;

DETAILED DESCRIPTION OF PREFERRED EMBODIMENTS

Figure 1:
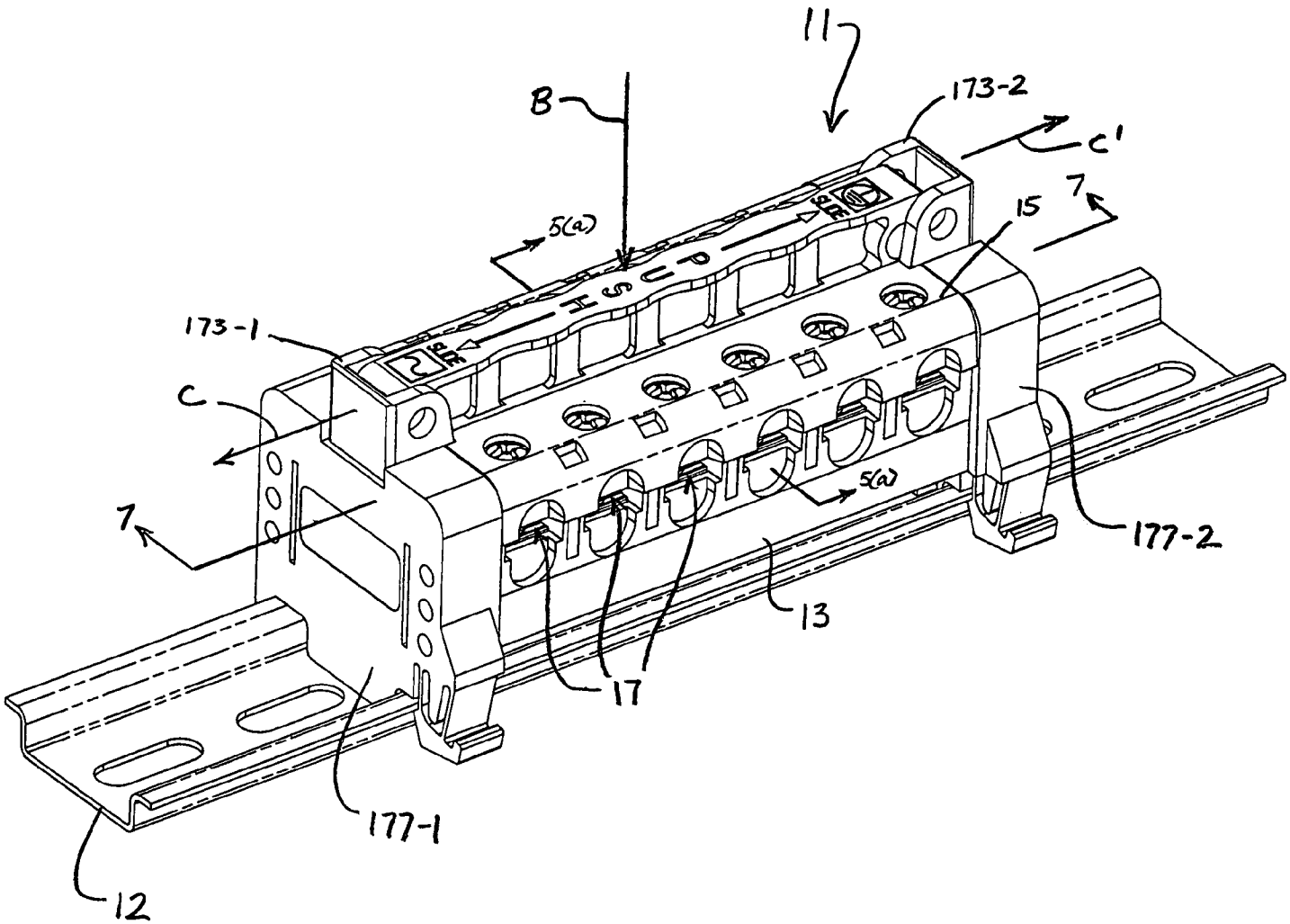
FIG. 1 is a front, top, left end perspective view of a terminal block constructed according to the teachings of the present invention, the terminal block being shown mounted on a conventional DIN rail.
Figure 2:
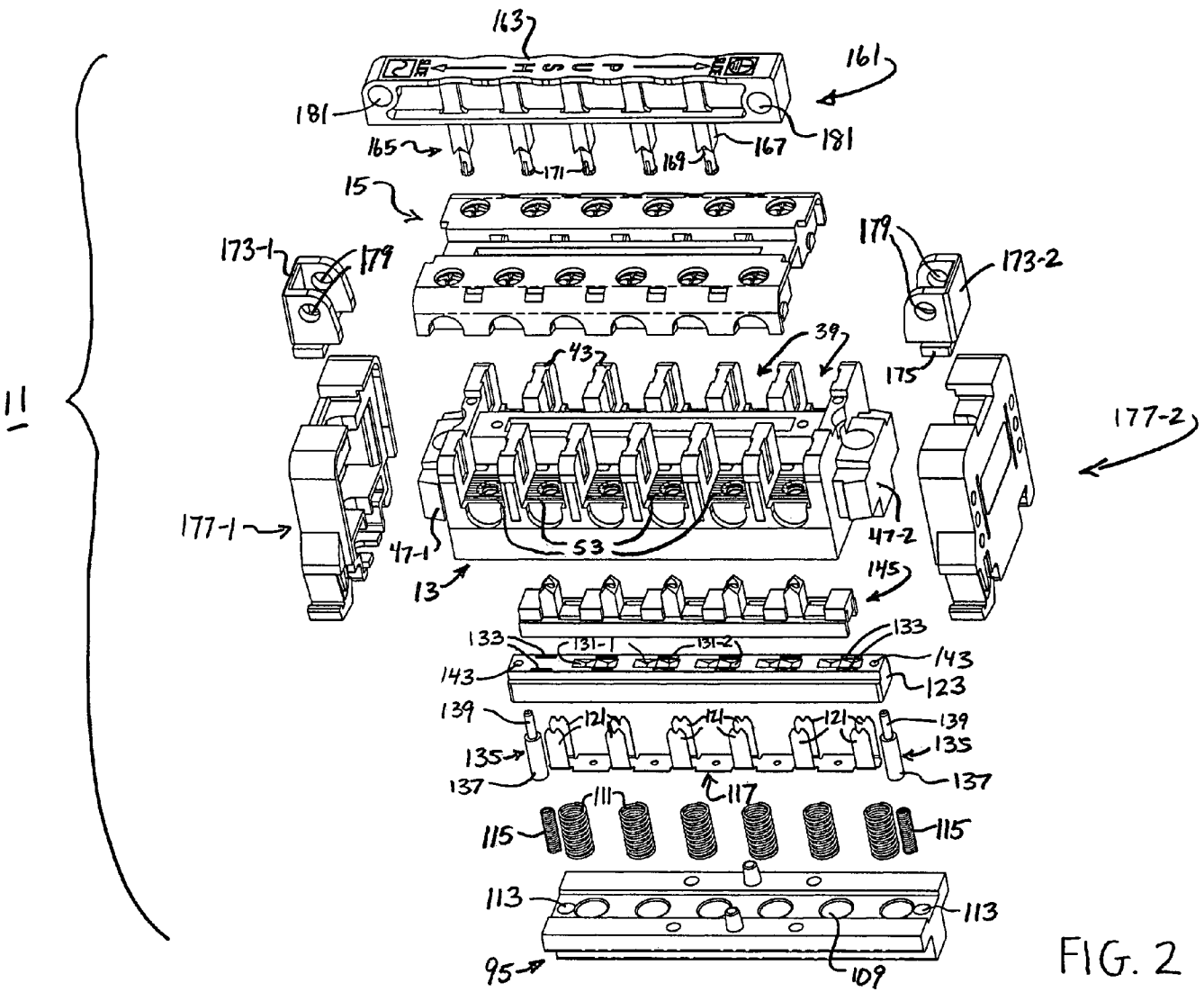
FIG. 2 is a front, top, right end, partially exploded perspective view of the terminal block assembly shown in FIG. 1.
Figure 3:
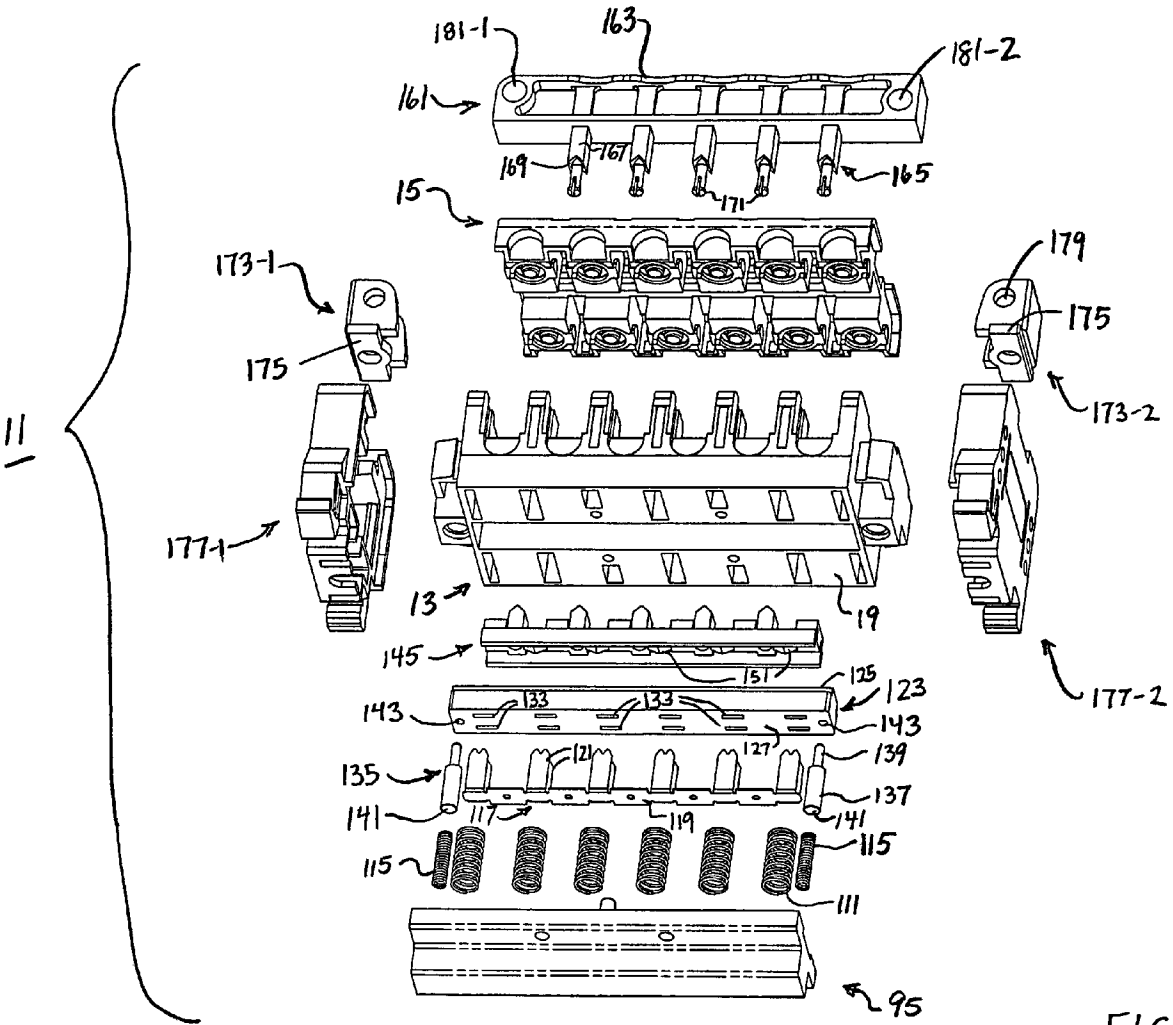
FIG. 3, is a front, bottom, right end, partially exploded perspective view of the terminal block assembly shown in FIG. 1.

Referring now to FIGS. 1–3, there is shown an electrical terminal block (also referred to herein simply as a terminal block) constructed according to the teachings of the present invention, the terminal block being represented generally by reference numeral 11. As will be described further below, terminal block 11 can be used to electrically connect at least one pair of wires. In addition, terminal block 11 is adapted to be mounted onto a conventional DIN rail 12, as seen most clearly in FIG. 1.

Terminal block 11 includes a base 13 and a cover assembly 15 adapted to be removably mounted onto base 13 by means of a forced snap fit. Together, base 13 and cover assembly 15 define six pairs of wire receiving receptacles 17, each pair of receptacles 17 being conductively coupled together, as will be described further below. However, it should be noted that terminal block 11 is not limited to a particular number of pairs of receptacles 17. Rather, it is to be understood that terminal block 11 could be constructed to include a fewer number of pairs of receptacles (e.g., 1 or 2) or a greater number of pairs of receptacles (e.g., 10 or 12) without departing from the spirit of the present invention.

Figure 4A:
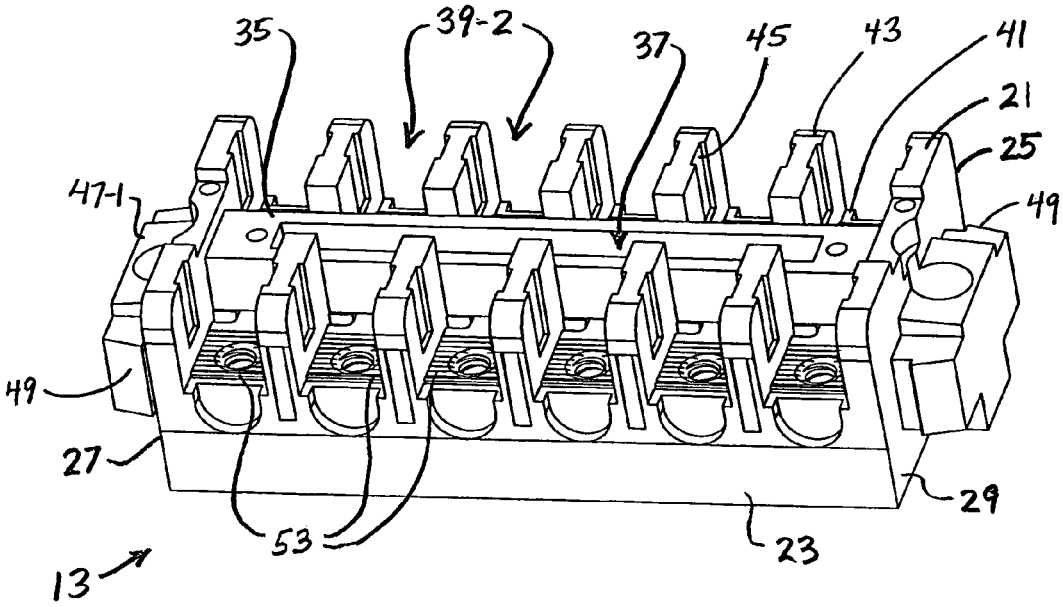
FIG. 4(*a*) is an enlarged, front, top, right end perspective view of the base and bus bars shown in FIG. 2.
Figure 4B:
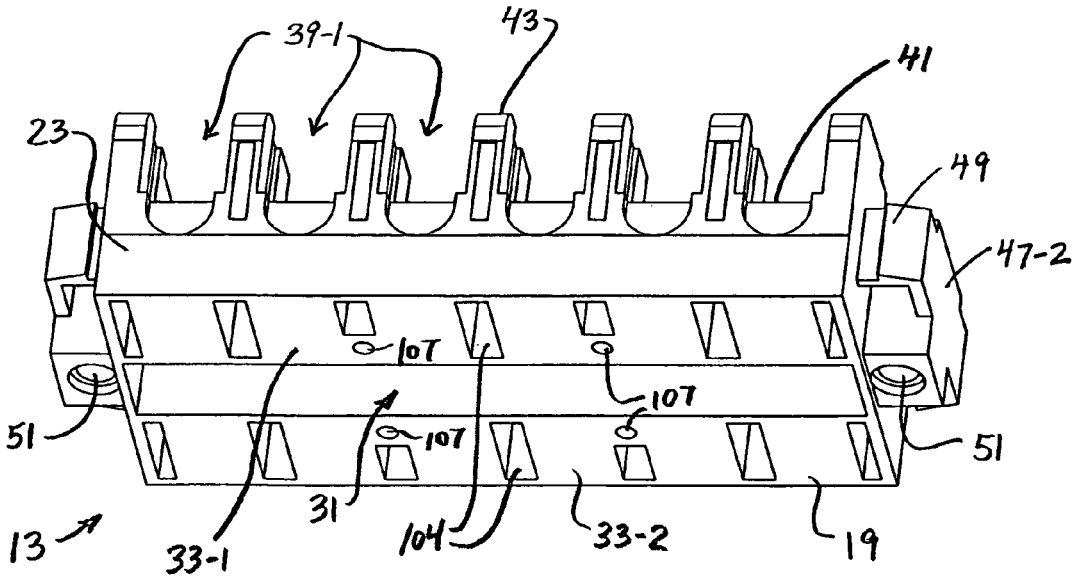

As seen most clearly in FIGS. 4(*a*) and 4(*b*), base 13 is constructed as an unitary piece of an insulating polyester material using conventional molding techniques. Base 13 has a modular, compact and generally block-shaped design. Specifically, base 13 comprises a substantially flat bottom surface 19, a substantially flat top surface 21, a substantially flat front surface 23, a substantially flat rear surface 25, a substantially flat left end surface 27 and a substantially flat right end surface 29.

Base 13 is shaped to define a slot 31 which is substantially rectangular in lateral cross-section, slot 31 extending longitudinally along the length of base 13 from left end surface 27 to right end surface 29. Slot 31 serves to create a pair of spaced apart, parallel, longitudinal support members 33-1 and 33-2 in base 13, slot 31 separating support member 33-1 from support member 33-2.

Base 13 is also shaped to include a narrow, rectangular, longitudinal partition 35 proximate top surface 21. Partition 35 is disposed in alignment within slot 31 and extends longitudinally along the length of base 13 from left end surface 27 to right end surface 29. Partition 35 is shaped to define an interior rectangular slot 37 along its length. Furthermore, partition 35 includes four spaced apart, parallel stops 38 which extend laterally across slot 37.

A plurality of spaced-apart recesses 39 are formed into top surface 21 along front surface 23 and similarly along rear surface 25, each recess 39 serving to create a small substantially horizontal platform 41 which is located at the approximate midpoint between top surface 21 and bottom surface 19. Specifically, six spaced apart recesses 39-1 are formed into top surface 21 of support member 33-1, each pair of adjacent recesses 39-1 being separated by a thin, vertical wall 43. Similarly, six spaced apart recesses 39-2 are formed into top surface 21 of support member 33-2, adjacent recesses 39-2 being separated by a thin, vertical wall 43. It should be noted that the inner surface of each vertical wall 43 that serves to at least partially define an associated recess 39 is provided with a shallow, vertically extending notch 45 which facilitates in aligning and retaining cover assembly 15 in its mounted position on base 13.

Base 13 is further shaped to include a pair of mounting blocks 47, one mounting block 47-1 being integrally formed onto the outer surface of left end surface 27 and another mounting block 47-2 being integrally formed onto the outer surface of right end surface 29. Each mounting block 47 is shaped to include a pair of opposing, outwardly protruding, ratchet shaped teeth 49. In addition, each mounting block 47 is shaped to define a vertically extending bore 51.

Each pair of receptacles 17 formed between base 13 and cover assembly 15 is conductively coupled together through a thin, laterally extending current, or bus, bar 53. As seen most clearly in FIGS. 5(*a*) and 5(*b*), each bus bar 53 is preferably formed from a unitary conductive material (e.g., metal) and includes first and second tabs 55-1 and 55-2 which are electrically coupled together by a connective portion 57. Each tab 55 is preferably shaped to define a threaded bore 59 which is adapted to receive a screw, as will be described further below.

In total, six parallel bus bars 53 extend laterally across base 13 within recesses 39 and between vertical walls 43. Each bus bar 53 is mounted on base 13 with its first and second tabs 55-1 and 55-2 mounted on opposing platforms 41 and with its connective portion 57 extending across slot 37. It should be noted that, because base 13 is constructed of an insulated material, tabs 55-1 of adjacent bus bars 53 (as well as tabs 55-2 of adjacent bus bars 53) are effectively electrically insulated from one another by walls 43, which is highly desirable.

As noted briefly above, cover assembly 15 is adapted to be removably mounted on base 13. As seen most clearly in FIGS. 5(*a*), 5(*b*), 6(*a*) and 6(*b*), cover assembly 15 includes a cover 61 shaped to define a plurality of vertically extending, generally cylindrical bores 63 and a plurality of captive screw assemblies 65 coupled to cover 61, each captive screw assembly 65 being retained (i.e., trapped) within a corresponding bore 63 in cover 61.

Cover 61 is constructed as an integral member of an insulated polyester material using conventional molding techniques. Cover includes a top surface 67, a bottom surface 69, a front surface 71 and a rear surface 73. A longitudinal recess 75, rectangular in lateral cross-section, is formed into top surface 67 along its length. A slot 77, in turn, is formed in cover 61 within recess 75. It should be noted that, with cover assembly 15 mounted on base 13, slot 77 provided in cover 61 is disposed in direct alignment above slots 31 and 37 in base 13.

Figure 6:
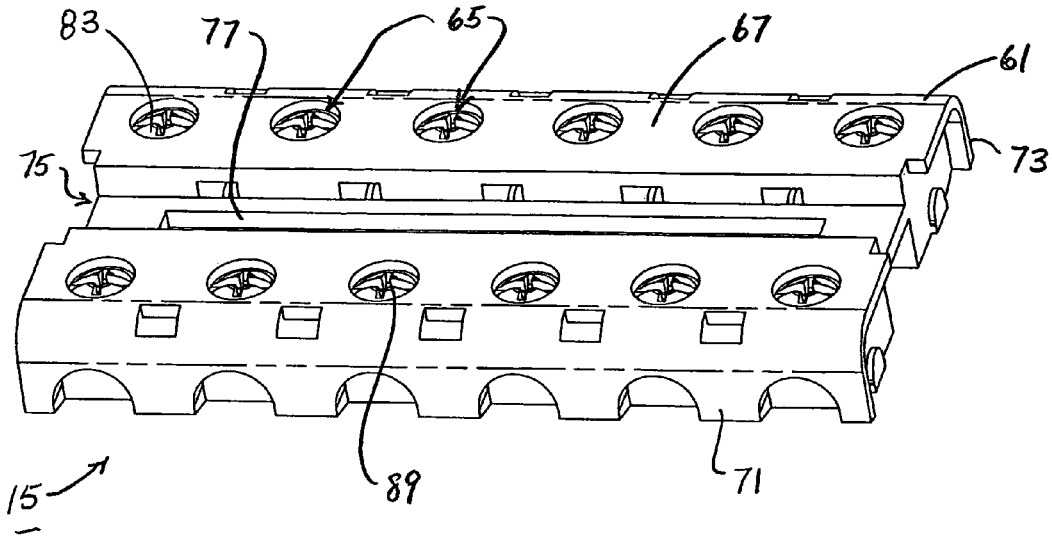
FIG. 6(*a*) is an enlarged, front, top, right end perspective view of the cover assembly shown in FIG. 2.
Figure 6:
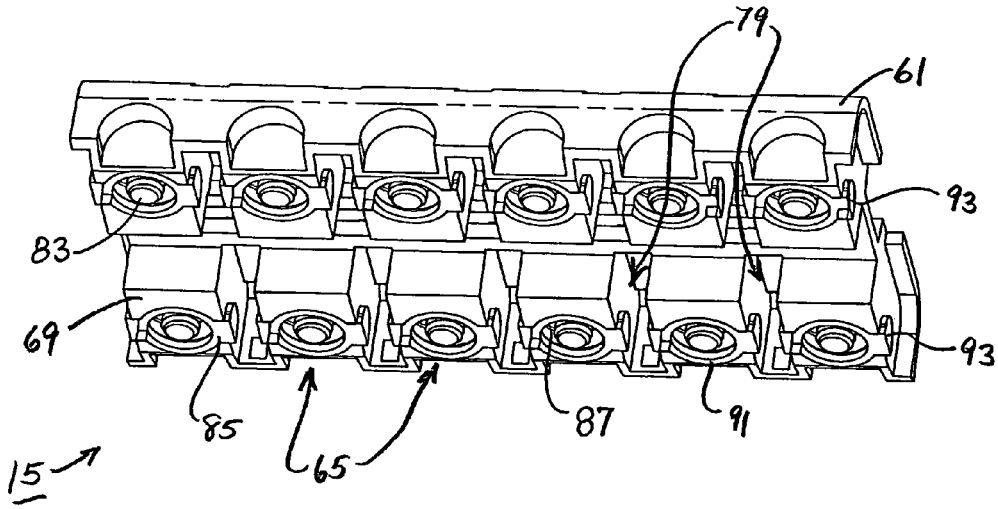
Figure 7:
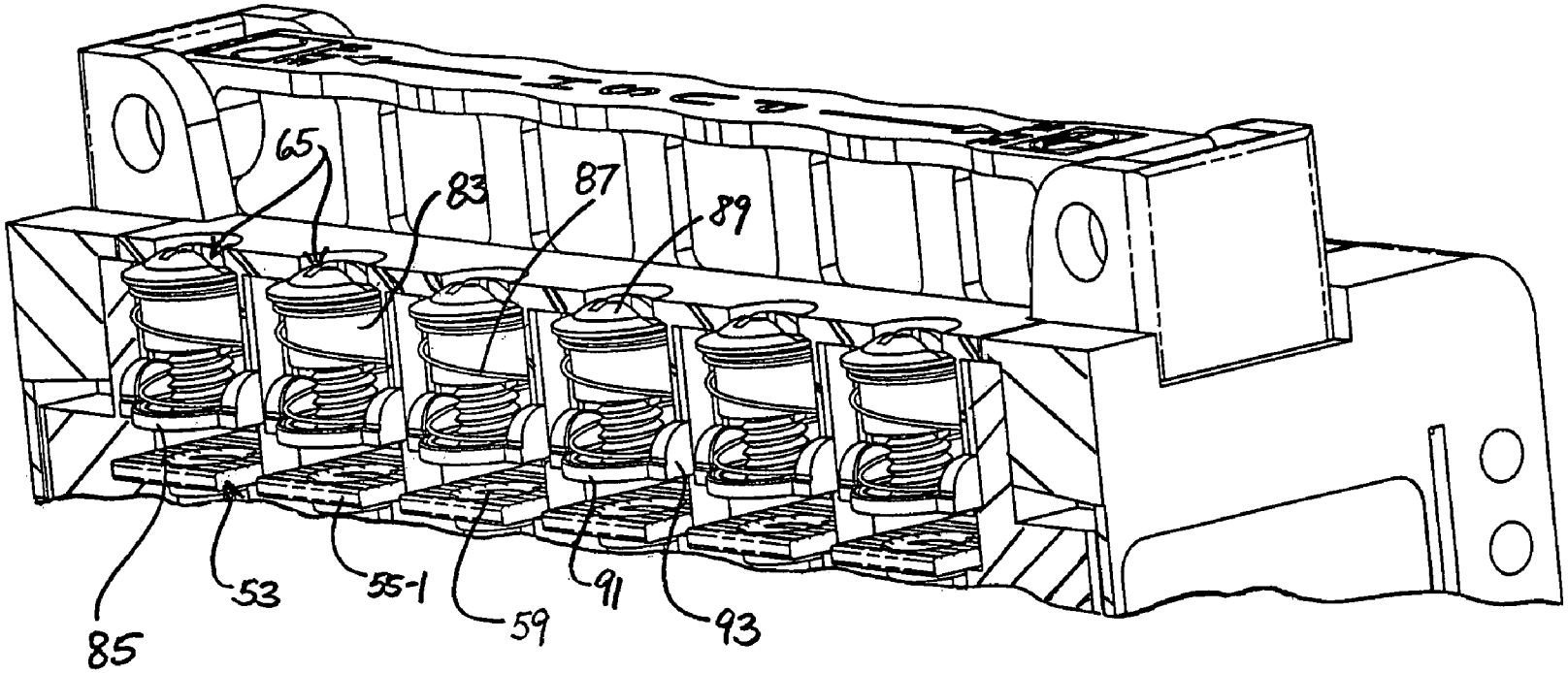
FIG. 7 is a fragmentary section view of the terminal block shown in FIG. 1 taken along lines 7—7, the captive screw assemblies and the bus bars shown therein being displayed in their entirety.

As seen most clearly in FIG. 6(*b*), a plurality of parallel, spaced-apart laterally extending grooves 79 are formed into bottom surface 69 of cover 61. It should be noted that each groove 79 is sized and shaped to fittingly receive an associated wall 43 in base 13. In this manner, cover 61 can be press-fit mounted onto base 13.

As noted above, cover 61 is shaped to define a plurality of bores 63, each bore 63 extending vertically through cover 61 from top surface 67 to bottom surface 69. An inwardly protruding lip 81 is formed into top surface 67 around each bore 63, as seen most clearly in FIGS. 5(*a*) and 5(*b*). As can be appreciated, each lip 81 serves to retain the outer surface of a screw head at a location spaced substantially down beneath top surface 67 of cover 61. In this capacity, the particular design of cover assembly 15 protects against inadvertent electric shock in the following two ways: (1) by recessing the head of each conductive screw substantially beneath top surface 67 of cover 61 (i.e., by creating a finger-safe cover) and (2) by manufacturing cover 61 out of an insulated material (i.e., by creating a deadfront cover).

As seen most clearly in FIGS. 6(*a*), 6(*b*) and 7, each captive screw assembly 65 includes a screw 83 disposed within a corresponding bore 63 in cover 61, a retaining ring 85 for keeping screw 83 in place within its associated bore 63 and a suspension spring 87 for continuously urging screw 83 upward towards top surface 67 of cover 61.

Screw 83 is preferably constructed of a conductive material, such as a nickel-plated steel, and includes an enlarged head 89 which is slotted to receive a screwdriver. Screw 83 is disposed within a corresponding bore 63 in cover 61 with its enlarged head 89 disposed directly beneath lip 81. In this manner, lip 81 permanently retains enlarged head 89 of screw 83 substantially beneath top surface 67 of cover 61 to prevent inadvertent contact therewith (which could result in electric shock).

Screw 83 is sized and shaped to be driven into threaded engagement within the corresponding bore 59 of a bus bar 53. Accordingly, with a the bare end of a wire (or a ring lug secured thereto) disposed between screw 83 and bus bar 53, the act of driving screw 83 into threaded engagement with bore 59 serves to draw the wire into secure electrical connection with bus bar 53.

Retaining ring 85 is preferably constructed of plastic and includes an annular portion 91 and a pair of opposing semi-circular wings 93 integrally connected thereto. Ring 85 is sized and shaped to be removably press-fit within a corresponding bore 63 in cover 61 along bottom surface 69, with each wing 93 of retaining ring 85 being fittingly disposed within an associated notch in cover 61. It should be noted that each wing 93 of retaining ring 85 projects slightly outward and partially into a groove 79 in cover 61 so that, with cover 61 mounted on base 13, each wing 93 fittingly aligns within a corresponding notch 45 in base 13 to facilitate in the proper alignment of cover 15 onto base 13.

Suspension spring 87 is disposed within bore 63 such that one of its ends urges upwardly against the underside of enlarged head 89 of screw 83 and the other of its ends urges downwardly onto annular member 91 of retaining ring 85. Preferably, annular member 91 of ring 85 is provided with a narrow groove to receive one end of spring 87.

It should be noted that suspension spring 87 and retaining ring 85 together serve to permanently maintain screw 83 in a captured position within bore 63. As a result, the user is never required to remove screw 83 from cover 61 prior to connecting a wire to a bus bar 53. Rather, in order to secure a wire to bus bar 53, the user is required to perform only two steps: (1) disposing the bare end of the wire in the air gap created between bus bar 53 and screw 83 (the air gap being created from spring 87 continuously urging screw 83 upward against the underside of lip 81 and away from bus bar 53) and (2) driving screw 83 into threaded engagement within bore 59 so as to draw the wire into contact against bus bar 53. As can be appreciated, the aforementioned two-step process is considerably simpler than most prior art means for connecting the bare end of a wire to a terminal block bus bar. As a consequence, the particular construction and means of operation for captive screw assembly 65 serves as a principal novel feature of the present invention.

As another principal novel feature of the present invention, terminal block 11 is provided with means for selectively shunting (i.e., grounding) all of the parallel bus bars 53 at the same time. Specifically, shunt means is provided which allows for switching, by hand, between a shunted position in which parallel bus bars 53 are commonly grounded and a de-shunted position in which parallel bus bars 53 are isolated from one another and are able to pass electrical current without said current being grounded. In this capacity, with said shunt means disposed in its de-shunted position, terminal block 11 can be used to electrically connect multiple pairs of wires. However, when deemed necessary for safety purposes (e.g., when an electrician is working with terminal block 11), shunt means can be disposed in its shunted position which, in turn, commonly grounds all of the bus bars 53. The details of said manually operable shunt means will be described in detail herein.

Figure 8A:
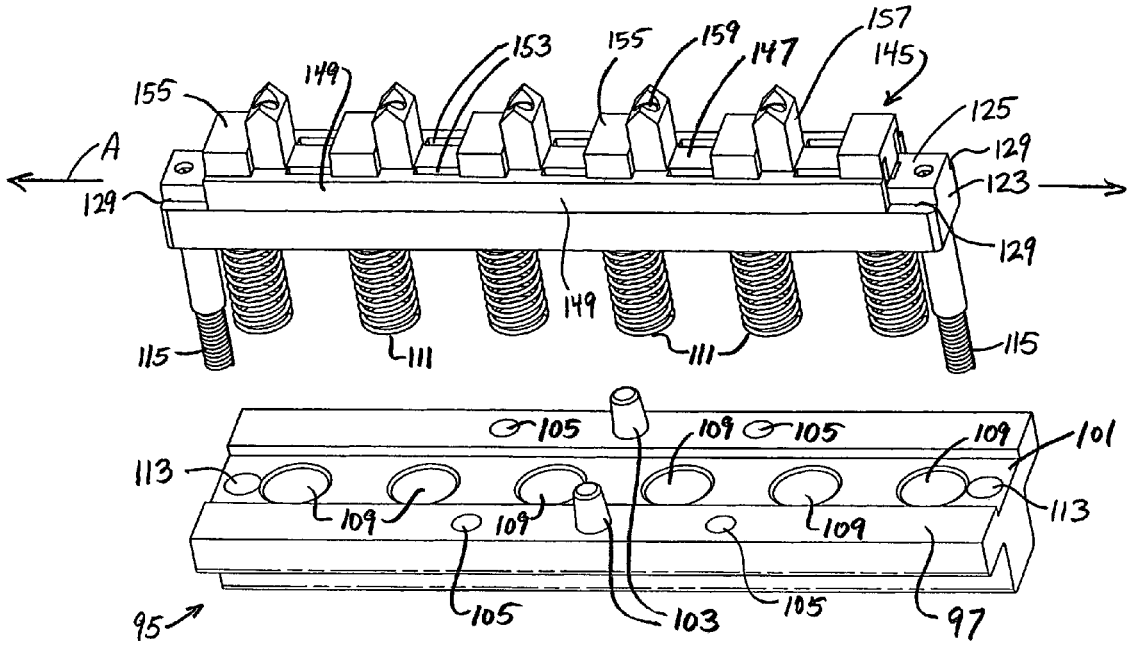
FIG. 8(*a*) is an enlarged, front, top, right end, partially exploded perspective view of the shunt carrier, springs, pins, shunt, shunt carrier and shuttle shown in FIG. 2.
Figure 8B:
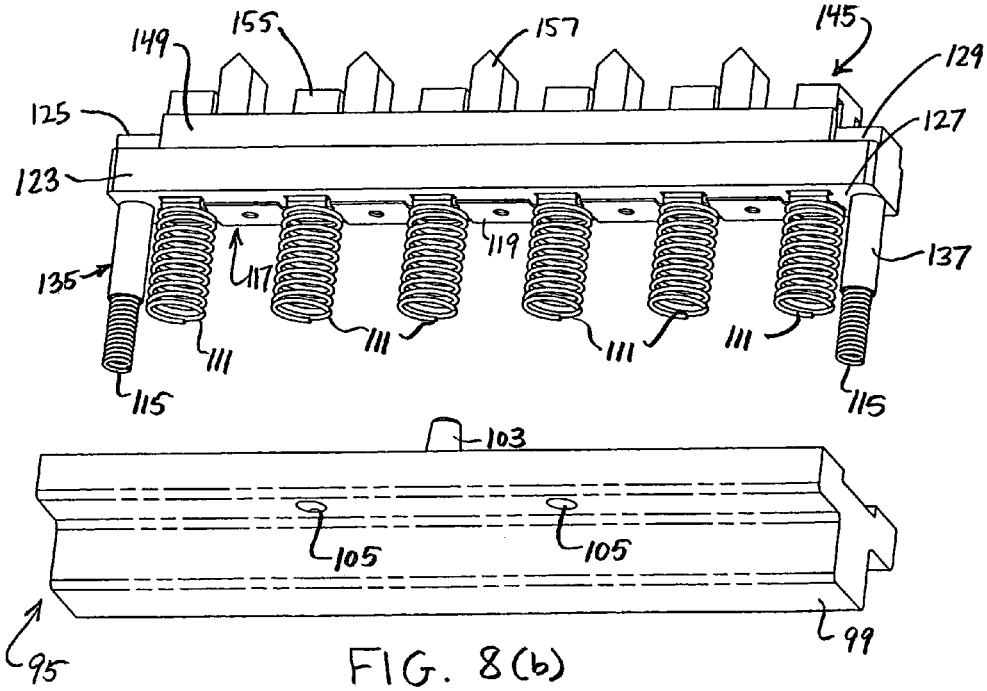

As seen most clearly in FIGS. 8(*a*) and 8(*b*), said shunt means includes a spring chamber 95 which is affixed to bottom surface 19 of base 13. Spring chamber 95 is constructed as an integral member of an insulated plastic material using conventional molding techniques. Spring chamber 95 has a generally T-shaped configuration in lateral cross-section along its entire length and includes a substantially flat top surface 97 and a substantially flat bottom surface 99. A shallow longitudinal recess 101 is formed into top surface 97 along the entire length of spring chamber 95.

Spring chamber 95 is provided with a pair of upwardly protruding posts 103 which are sized and shaped to be fittingly received within corresponding holes 104 formed in bottom surface 19 of base 13 to adequately secure spring chamber 95 in place against base 13. In addition, spring chamber 95 is provided with four vertically extending bores 105 which axially align with four holes 107 formed in bottom surface 19 of base 13. As can be appreciated, a rivet (not shown) can be driven through each complimentary pair of bore 105 and hole 107 in order to further secure spring chamber 95 in place against base 13.

Six holes 109 are formed into spring chamber 95 within recess 101, holes 109 being linearly arranged and equidistantly spaced apart from one another. Each hole 109 is uniformly circular in lateral cross-section and is sized and shaped to retain one end of a shunt spring 111, each shunt spring 111 being constructed of a conductive material, such as metal. Each shunt spring 111 is deposited into a corresponding hole 109 such that its free end extends orthogonally upward relative to top surface 97 of spring chamber 95.

Similarly, a pair of reduced diameter holes 113 are formed into spring chamber 95 within recess 101 just outside the outermost holes 109. Each hole 113 is sized and shaped to retain one end of a compression spring 115. Each compression spring 115 is deposited into a corresponding hole 113 such that its free end extends orthogonally upward relative to top surface 97 of spring chamber 95.

As seen most clearly in FIGS. 2, 3 and 8(*b*), a conductive shunt 117 is disposed in contact against and longitudinally across the free end of each spring 111. Shunt 117 is constructed from a single piece of conductive material, such as metal, which can be formed through one or more conventional stamping processes. Shunt 117 includes an elongated flat strip 119 which is linearly disposed across the free ends of springs 111. Shunt 117 additionally includes multiple pairs of spaced apart arms 121 which are formed along the length of flat strip 119, each pair of arms 121 protruding upwardly at a right angle relative to the top surface of flat strip 119. As will be described further below, with terminal block 11 in its assembled form, each pair of arms 121 on shunt 117 aligns directly beneath a corresponding bus bar 53. Accordingly, the upward force applied onto shunt 117 by springs 111 serves to urge each pair of arms 121 into contact with a corresponding bus bar 53, as will be described further below.

A shunt carrier 123 is mounted over shunt 117 and, in turn, is coupled to spring chamber 95. Specifically, shunt carrier 123 is preferably constructed from a single piece of insulated material, such as plastic, and is formed as an elongated, substantially rectangular, solid block which includes a flat top surface 125 and a flat bottom surface 127. A pair of notches 129 are formed into top surface 125 along the entire length of its front and rear walls. In addition, as seen most clearly in FIG. 2, multiple pairs of recesses 131 are formed into top surface 125 of shunt carrier 123, each recess 131 being generally triangular in longitudinal cross-section. Each pair of recesses 131 includes a first recess 131-1 and a second recess 131-2 which are disposed adjacent to one another and which are positioned in a linear configuration, the function of recesses 131 to be described further in detail below.

Shunt carrier 123 is also shaped to define a plurality of slots 133, each slot 133 extending vertically through shunt carrier 123 from bottom surface 127 to top surface 125. As can be appreciated, each slot 133 is sized, shaped and positioned to fittingly receive a corresponding arm 121 in shunt 117, as seen most clearly in FIG. 8(*b*). In this manner, shunt carrier 123 can be fixedly mounted over shunt 117, with each arm 121 protruding up through a corresponding slot 133 (i.e., in the direction from bottom surface 127 to top surface 125) and with the topside of strip 119 disposed against bottom surface 127 of shunt carrier 123.

With shunt carrier 123 fixedly mounted onto shunt 117 in the manner described above (and with each shunt spring 111 axially deposited within a corresponding hole 109 in spring chamber 95 and with each compression spring 115 axially deposited within a corresponding hole 113 in spring chamber 95), shunt carrier 123 is then, in turn, coupled to spring chamber 95. Specifically, a pair of pins 135 are used to couple shunt carrier 123 onto spring chamber 95, each pin 135 including a first end 137 and a second end 139. First end 137 of each pin 135 is shaped to include a longitudinal bore 141 which is sized and shaped to axially receive the free end of an associated compression spring 115, as seen most clearly in FIG. 8(*b*). With free end of spring 115 inserted into bore 141, each pin 135 is disposed to extend vertically upward at a right angle relative to top surface 97 of spring chamber 95 and is capable of vertical displacement relative thereto (i.e., upon compression of spring 115). Second end 139 of each pin 135 is fittingly inserted into a corresponding hole 143 that is formed in bottom surface 127 of shunt carrier 123, thereby fixedly coupling shunt carrier 123 to pins 135. With shunt carrier 123 fixedly mounted onto pins 135, shunt carrier 123 aligns directly above recess 101 formed in top surface 97 of spring chamber 95.

It should be noted that, with terminal block 11 configured in its assembled form, springs 111 and 115 resiliently urge shunt carrier 123 up and away from within recess 101 in spring chamber 95. However, the compressibility of springs 111 and 115 enable shunt carrier 123 (and, in turn, shunt 117) to move vertically downward towards spring chamber 95 upon the application of a suitable downward force on shunt carrier 123 (with pins 135 precluding shunt carrier 123 from any longitudinal or lateral displacement). Once said downward force is removed, the resilient nature of springs 111 and 115 urges shunt carrier 123 (and, in turn, shunt 117) back upward to its original position relative to spring chamber 95. As will become evident below, the ability to displace shunt carrier 123 and shunt 117 in the vertical direction is used to lock/unlock (i.e., ratchet) in place said shunt means between its shunted and de-shunted positions.

Referring now to FIGS. 8(*a*), 8(*b*) and 9(*a*)–(*c*), a shuttle 145 is slidably mounted on shunt carrier 123 and is adapted to releasably lock in place between two positions, as will be described further below. Shuttle 145 is preferably constructed as a unitary piece of a plastic material through conventional molding techniques. As seen most clearly in FIG. 3, shuttle 145 is generally U-shaped in lateral cross-section along its length. Specifically, shuttle 145 includes a substantially flat platform 147 and a pair of rails 149 which extend orthogonally downward from platform 147.

Shuttle 145 is slidably mounted on shunt carrier 123 with the underside of platform 147 disposed against top surface 125 of shunt carrier 123 and with each rail 149 of shuttle 145 aligning within an associated notch 129 formed in shunt carrier 123, as seen most clearly in FIGS. 8(*a*) and 8(*b*). Due to the interrelationship between shuttle 145 and shunt carrier 123, shuttle 145 is capable of being longitudinally slid (as represented by arrows A in FIG. 8(*a*)) relative to shunt carrier 123 (the engagement of rails 149 within notches 129 serving to prevent any lateral sliding of shuttle 145 relative to shunt carrier 123).

A plurality of projections 151 are formed onto the underside of platform 147, each projection 151 being substantially triangular in longitudinal cross-section. Each projection 151 is sized and shaped to protrude (i.e., ratchet) into either first recess 131-1 or second recess 131-2 in shunt carrier 123. In this manner, projections 151 facilitate in retaining shuttle 145 in either of two positions relative to shunt carrier 123, as will be described further below.

A plurality of elongated longitudinal slots 153 are formed in platform 147 of shuttle 145. Slots 153 are formed into platform 147 as pairs, with one of said pair of slots 153 being disposed along one rail 149 and the other of said pair of slots 153 being disposed along the other rail 149. Each slot 153 is sized and shaped to permit an arm 121 of shunt 117 to penetrate therethrough. However, it should be noted that the length of each slot 153 is approximately two times the length of each arm 121. In this capacity, it is to be understood that shuttle 145 can be slid longitudinally between two positions relative to shunt carrier 123 (and, in turn, shunt 117) while maintaining each arm 121 of shunt 117 penetrating through its corresponding slot 153.

Figure 5A:
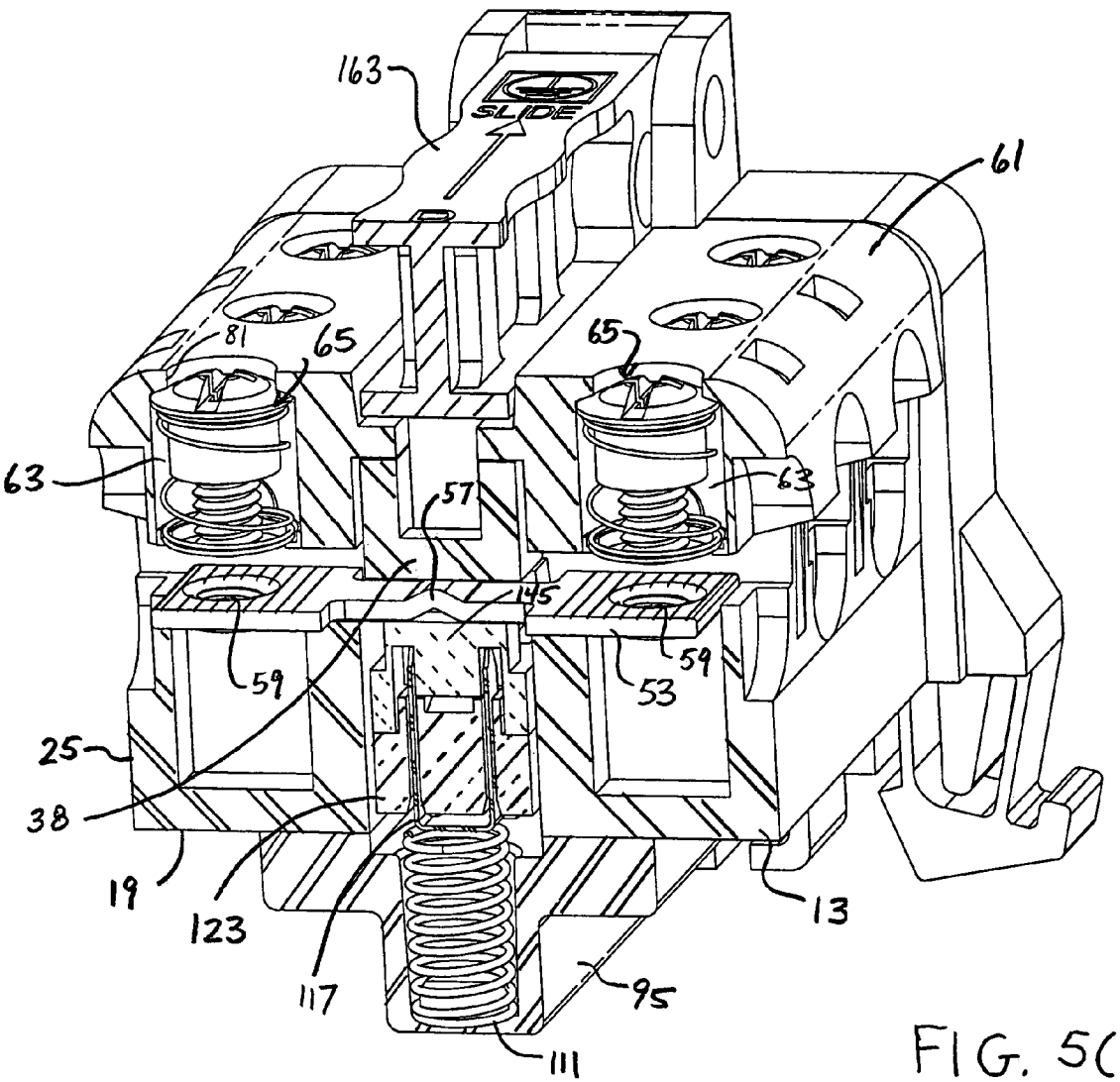
FIG. 5(*a*) is a section view of the terminal block shown in FIG. 1 taken along lines 5(*a*)—5(*a*), the captive screw assemblies and the bus bars shown therein being displayed in their entirety, the terminal block shown with the shunt electrically insulated from each of the bus bars by the shuttle.
Figure 5B:
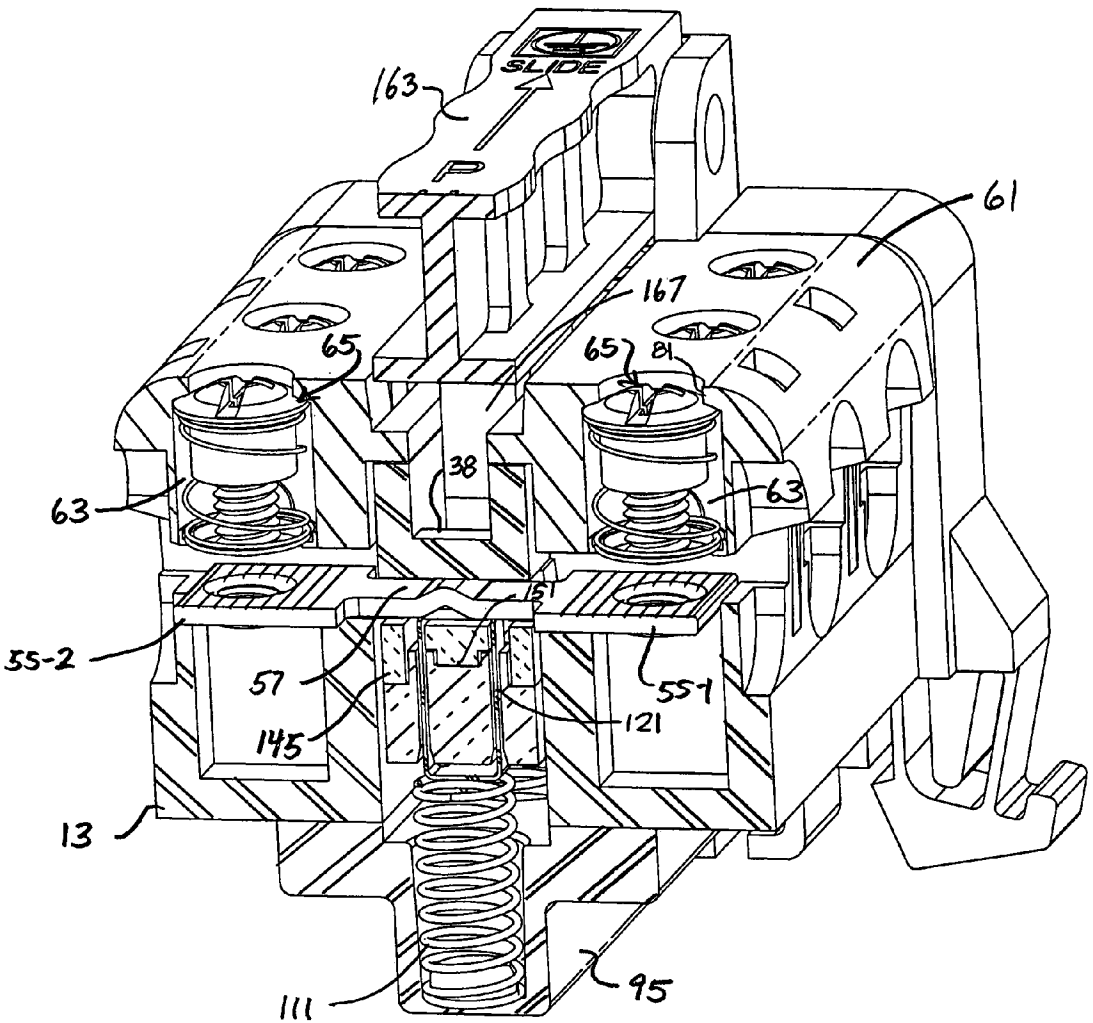
Figure 9C:
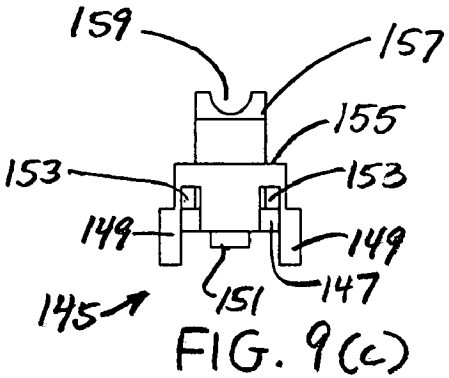
FIGS. 9(*a*)–(*c*) are enlarged front, bottom and right end plan views, respectively, of the shuttle shown in FIG. 2.
Figure 9A:
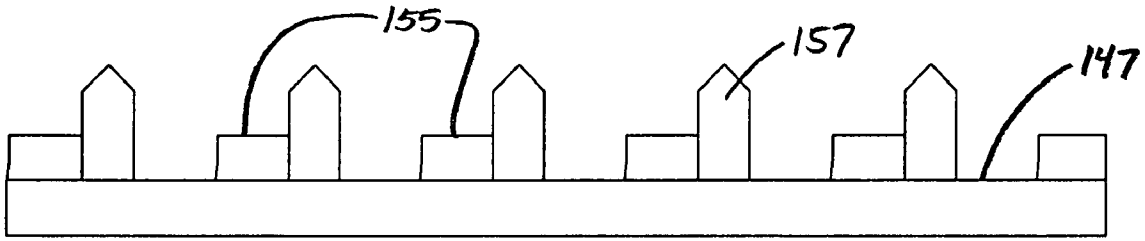
Figure 9B:
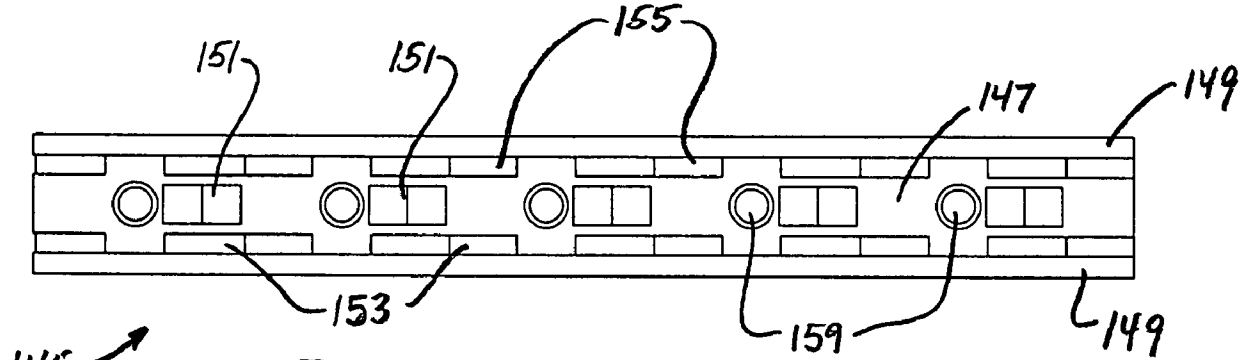

A plurality of raised steps 155 are formed onto the top surface of platform 147, each step 155 being in the form of a substantially enclosed block. It should be noted that each step 155 is positioned directly over a portion of the length of a pair of corresponding slots 153, as seen most clearly in FIG. 9(*b*). In this manner, with shuttle 145 disposed in its first position (as shown in FIGS. 5(*a*), 8(*a*) and 8(*b*)), arms 121 of shunt 117 penetrate through slots 153 in shuttle 145 but are disposed directly beneath steps 155. As a result, the free ends of arms 121 are covered by steps 155, thereby effectively insulating arms 121 of shunt 117 from bus bars 53. However, with shuttle 145 disposed in its second position, arms 121 of shunt 117 penetrate through slots 153 at a location spaced away from steps 155 such that the free ends of arms 121 are exposed for direct contact against bus bars 53 (as shown in FIG. 5(*b*)).

A plurality of spaced apart projections 157 are formed onto top surface of platform 147. Each projection 157 is in the form of a pencil-shaped stem which protrudes orthogonally outward from platform 147, the free end of each projection 157 having a sharpened, or pointed, tip. Each projection is additionally shaped to define a longitudinally extending bore 159 along its length. As will be described further below, the particular construction of projections 157 allows for a shunt switch 161 to be fixedly coupled thereto, shunt switch 161 enabling the user to readily disposed the shunt means for terminal block 11 between its de-shunt and shunt positions.

Figure 10:
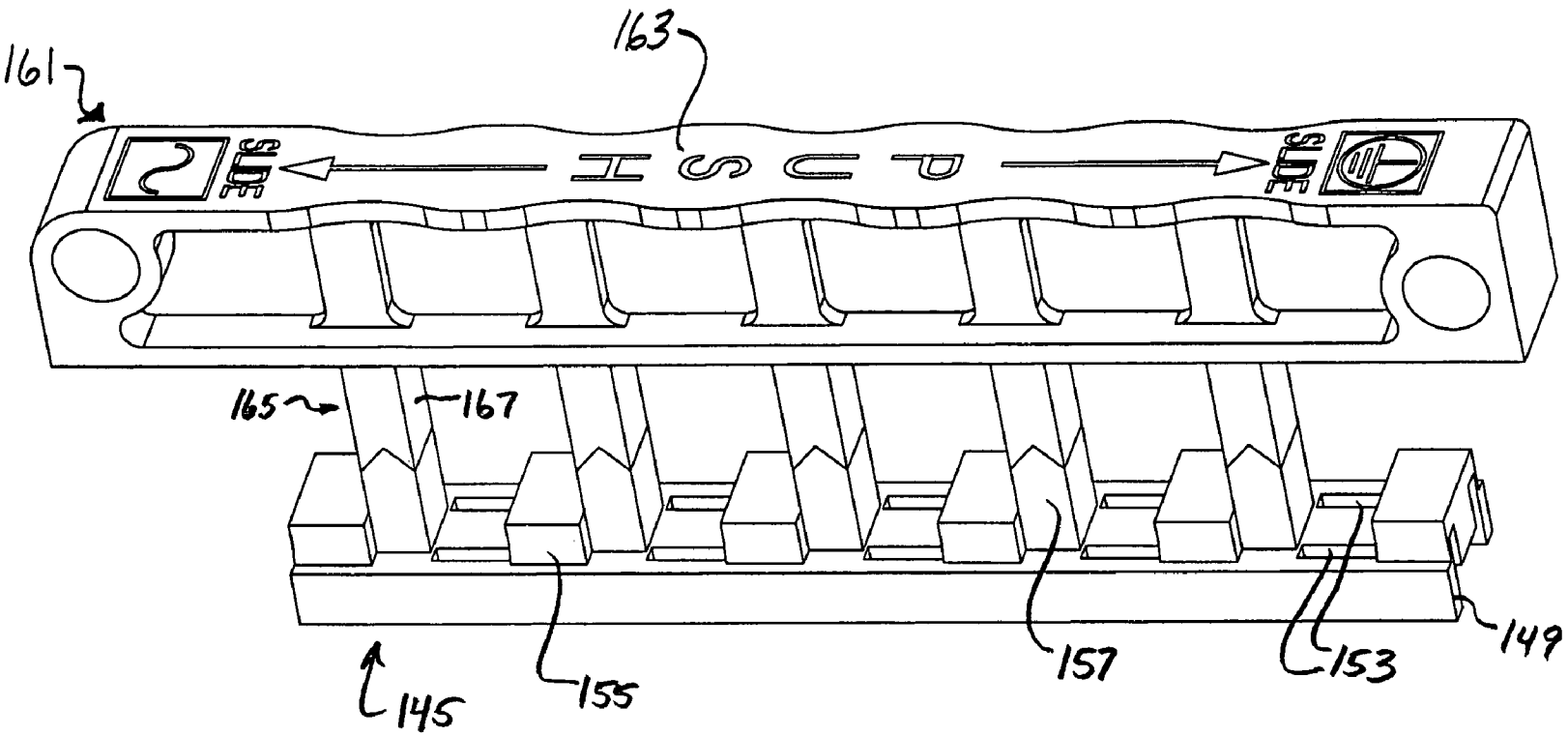
FIG. 10 is an enlarged, front, top, right end perspective view of the shunt switch and shuttle shown in FIG. 2.

Specifically, referring now to FIGS. 2, 3 and 10, shunt switch 161 is constructed as a unitary member from an insulated polyester material using conventional molding techniques. Shunt switch 161 includes an elongated, rectangular handle 163 which is sized and shaped to allow for easy manipulation by hand. Handle 163 is preferably provided with indicia printed thereon to facilitate in operating the shunt means for terminal block 11.

Shunt switch 161 additionally includes a plurality of spaced-apart fasteners 165 which are integrally formed onto and project orthogonally out from the underside of handle 163. Each fastener 165 includes a stem 167 which protrudes orthogonally out from the underside of handle 163, stem 167 being generally rectangular in lateral cross-section. It should be noted that free end 169 of each stem 167 includes a V-shaped notch which is sized and shaped to matingly engage with the sharpened tip of a corresponding projection 157 on shuttle 145. In addition, each fastener 165 includes a slotted arrowhead 171 of reduced cross-sectional diameter. Each slotted arrowhead 171 is sized and shaped to penetrate through a bore 159 in an associated projection 157 so as to create a snap-fit engagement between shunt switch 161 and shuttle 145, as seen most clearly in FIG. 10.

As seen most clearly in FIGS. 1, 5(*a*) and 5(*b*), with shunt switch 161 fixedly coupled to shuttle 145, the underside of handle 163 is disposed in alignment within recess 75 in cover 61, thereby limiting shunt switch 161 to longitudinal displacement (i.e., precluding lateral displacement) relative to cover 61. Furthermore, with shunt switch 161 fixedly coupled to shuttle 145, fasteners 165 project down through slot 77 in cover 61 and through slot 37 in partition 35, with each fastener 165 disposed between a pair of successive stops 38 in base 13.

A pair of latching lugs 173-1 and 173-2 are press-fit mounted onto base 13, as seen most clearly in FIGS. 1–3. Each latching lug 173 is constructed of plastic in the form of a U-shaped bracket and includes a horizontal retention plate 175 which are sized and shaped to be connected to a corresponding end cap 177 which, in turn, is coupled to base 13, as will be described further below.

Each latching lug 173 is shaped to define a pair of circular openings 179. Similarly, each end of handle 163 is similarly shaped to define a lateral bore 181. As a result, with handle 163 disposed in its first position (i.e., with said shunt means for terminal block 11 disposed in its de-shunted position), bore 181-1 in handle 163 is disposed in axial alignment with openings 179 in latching lug 173-1. Furthermore, with handle 163 disposed in its second position (i.e., with said shunt means for terminal block 11 disposed in its shunted position), bore 181-2 in handle 163 is disposed in axial alignment with openings 179 in latching lug 173-2. In this manner, a locking post (not shown) can be disposed through latching lug 181-1 and handle 163 (with handle 163 disposed in its first position) or, in the alternative, through latching lug 181-2 and handle 163 (with handle 163 disposed in its second position) to lockably secure the position of shunt switch 161 in either of its two positions.

In use, terminal block 11 can be used in the following manner to couple together at least one pair of wires. Specifically, the bare end of a first wire is disposed a receptacle 17 in terminal block 11 and is conductively coupled to first tab 55-1 of a bus bar 53 by driving captive screw 83 into threaded engagement with the bore 59 in said tab 55-1. Similarly, the bare end of a second wire is disposed into the opposing receptacle 17 and is conductively coupled to second tab 55-2 of the same bus bar 53 by driving captive screw 83 into threaded engagement with the bore 59 in said tab 55-2. Having completed the aforementioned connections, it is to be understood that the conductive nature of bus bar 53 serves to electrically connect the first wire with the second wire. As can be appreciated, additional wire pairs may be electrically coupled together in a similar manner using the remaining receptacles 17 and remaining bus bars 53.

With the first and second wires coupled together through bus bar 53 in the manner described in detail above, shunt switch 161 can be manually displaced between its first and second positions in order to selectively and commonly shunt all of bus bars 53. Specifically, in order to move shunt switch 161, the user is required to apply a suitable downward force (i.e., a force greater than the cumulative force of springs 111 and 115) onto switch handle 163 (as represented by arrow B in FIG. 1) which, in turn, drives shuttle 145, shunt carrier 123 and shunt 117 (which are all coupled together) downward towards spring chamber 95. It should be noted that the application of this suitable downward force ultimately causes shuttle 145 to disengage (i.e., project substantially beneath) stops 38 in base 13.

While maintaining the downward force on switch handle 163 (thereby disengaging shuttle 145 from base 13), switch handle 161 is free to be longitudinally displaced in either of two opposing directions (as represented by arrows C and C' in FIG. 1), the fasteners 165 on switch handle 161 abutting against stops 38 in base 13 to limit the degree of longitudinal displacement in both directions. It should be noted that the longitudinal displacement of switch handle 161, in turn, causes shuttle 145 to longitudinally slide along shunt carrier 123, as represented by arrow A in FIG. 8(*a*), with shunt carrier 123 and shunt 117 remaining fixed in place.

In order to place said shunt means for terminal block 11 in its de-shunted position, shunt switch 161 is disposed into its first position. Namely, switch handle 163 is longitudinally displaced in the direction of arrow C in FIG. 1 while maintaining a suitable downward force (as represented by arrow B in FIG. 1). Upon the removal of said downward force, springs 111 and 115 resiliently urge shunt 117, shunt carrier 123 and shuttle 145 upward. At this point, the longitudinal position of shuttle 145 relative to shunt carrier 123 is such that arms 121 of shunt 117 are disposed directly beneath steps 155 in shuttle 145. As a result, arms 121 of shunt 117 are effectively insulated (i.e., spaced adequately out of contact) from bus bars 53 by steps 155 in shuttle 145, as seen most clearly in FIG. 5(*a*). Projections 151 on the underside of shuttle 145 engage recesses 131-1 in shunt carrier 123 to prevent further longitudinal displacement of shuttle 145, thereby retaining shunt switch 161 in its first position. Additionally, a locking pin (not shown) may be disposed through openings 179 in latching lug 173-1 and bore 181-1 in handle 163 to secure switch handle 163 in its first position. As can be appreciated, shunt switch 161 in its first position (i.e., with said shunt means disposed in its de-shunt position), current can freely travel along bus bar 53 to electrically couple the first and second wires connected thereto.

In order to place said shunt means for terminal block 11 into its shunting position, shunt switch 161 is displaced in the direction of arrow C' in FIG. 1 while preferably maintaining a suitable downward force (as represented by arrow B in FIG. 1). Upon completion of said longitudinal displacement, springs 111 and 115 resiliently urge shunt 117, shunt carrier 123 and shuttle 145 upward. The longitudinal position of shuttle 145 relative to shunt carrier 123 at this point is such that arms 121 of shunt 117 penetrate entirely through slots 153 at a location spaced adequately away from steps 155. As a result, arms 121 of shunt 117 are drawn into direct contact against the underside of connective portion 57 of each bus bar 53, as seen most clearly in FIG. 5(*b*). In this manner, bus bars 53 are all commonly conductively coupled to shunt 117. Projections 151 on the underside of shuttle 145 engage recesses 131-2 in shunt carrier 123 to help retain shunt switch 161 in its second position. In addition, steps 155 on shuttle 145 abut against connective portion 57 of bus bars 53 to help retain shunt switch 161 in its second (i.e., shunted) position. Furthermore, a locking pin (not shown) may be disposed through openings 179 in latching lug 173-2 and bore 181-2 in handle 163 to retain shunt switch 161 in its second position. As can be appreciated, with shunt switch 161 disposed in its second position, any current present on any/all of bus bars 53 is drawn into shunt 117, thereby effectively disconnecting (i.e., opening) the electrical current path established between the first and second wires. In this manner, any/all electrical charge present in the various bus bars 53 of terminal block 11 is effectively shunted together and, in a separate step, can be commonly grounded (e.g., by connecting one end of a single bus bar 53 to ground) so as to protect an electrician from electrical shock.

Figure 11:
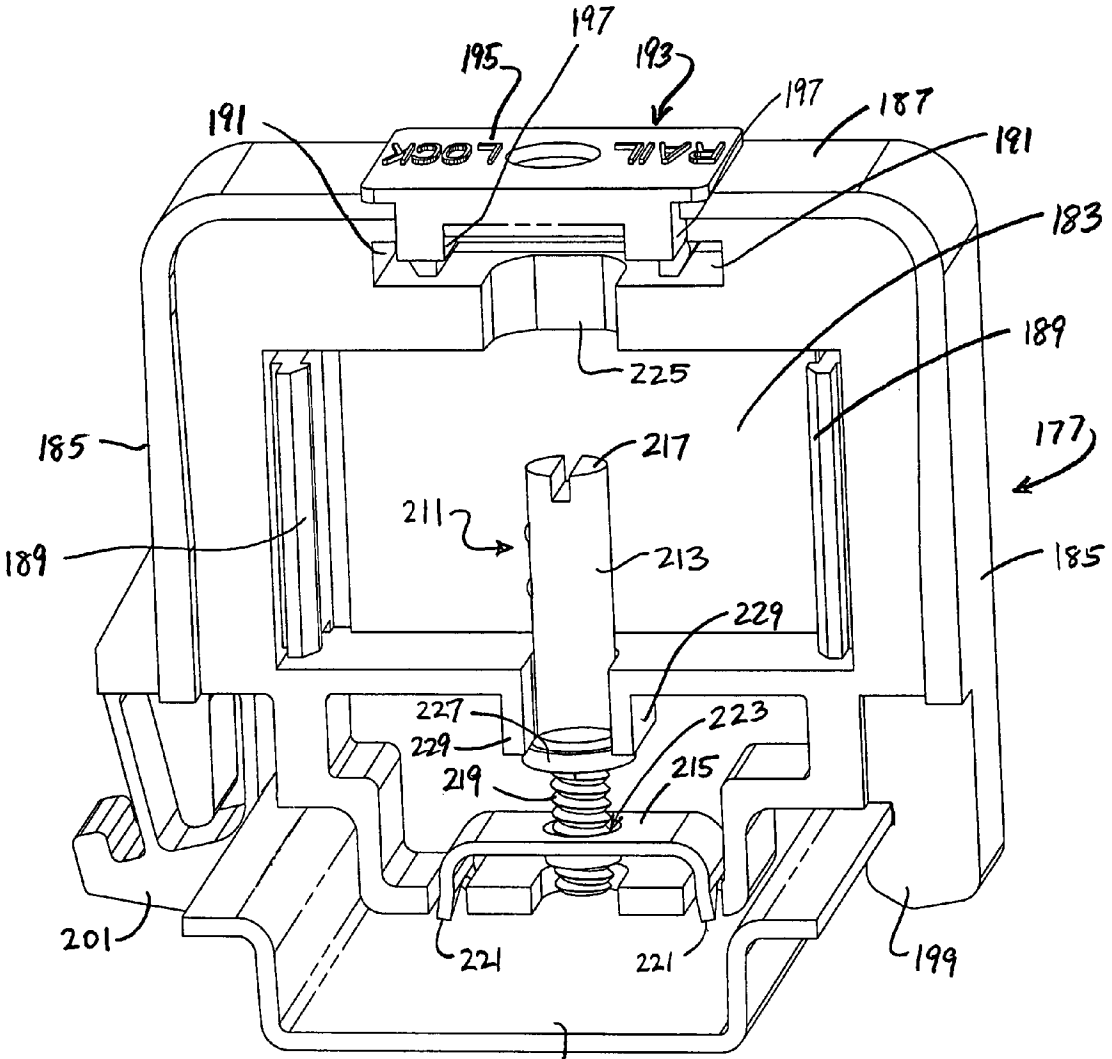
FIG. 11 is an enlarged, front, top, left end perspective view of the end cap shown in FIG. 2, the end cap being shown mounted on the DIN rail shown in FIG. 1, the end cap being shown with a marker and a DIN rail lock (each constructed according to the teachings of the present invention) coupled thereto.

Referring now to FIGS. 1, 2 and 11, terminal block 11 includes a pair of end caps 177-1 and 177-2 which are removably mounted onto opposite ends of base 13. As will be described further below, end caps 177 enable base 13 to be mounted onto conventional DIN rail 12. However, it is to be understood that terminal block 11 is not limited to including DIN rail mountable end caps 177. Rather, it should be noted that terminal block 11 is designed such that end caps 177 could be removed from base 13 and be readily interchanged with alternative types of end caps (e.g., panel mountable end caps) without departing from the spirit of the present invention. As can be appreciated, the ability of to readily interchange the types of end caps for terminal block 11 increases the range of potential mounting applications for terminal block 11 and therefore serves as a novel feature of the present invention.

Each end cap 177 is constructed as a unitary plastic member using conventional molding techniques. As seen most clearly in FIG. 11, end cap 177 includes an outer end wall 183, a pair of orthogonally disposed side walls 185, and a top wall 187. It should be noted that the inner surface of each side wall 185 is provided with in inwardly protruding, ratchet-shaped rib 189 which enables end cap 177 to be pressed (i.e., snap-fit mounted) onto a corresponding mounting block 47 on base 13. Specifically, each end cap 177 can snap-fit mounted onto a corresponding mounting block 47 on base 13 so that ribs 189 on end cap 177 engage the underside of ratchet shaped teeth 49 on mounting block 47. In this manner, it is also to be understood that each end cap 177 can be removed from its associated mounting block 47 by pulling end cap 177 outward in the opposite direction using a considerable withdrawal force.

Each end cap 177 is also shaped to include a pair of L-shaped slots 191 in top wall 187. Together, slots 191 in end cap 177 are sized and shaped to fittingly receive retention plate 175 of a corresponding latching lug 173, as seen most clearly in FIGS. 1 and 2. In this manner, latching lug 173 can be removably coupled to a corresponding end cap 177 by sliding its retention plate 175 within slots 191 in end cap 177.

However, it is to be understood that slots 191 in end cap 177 are not limited to receiving a corresponding latching lug 173. Rather, it is to be understood that slots 191 in end cap 177 are sized and shaped to alternative components, if desired, without departing from the spirit of the present invention. Specifically, if the shunting means for terminal block 11 were removed therefrom, a marker 193 may alternatively be slidably mounted within slots 191 in end cap 177 without departing from the spirit of the present invention.

As seen most clearly in FIG. 11, marker 193 comprises a substantially flat plate 195 with identifying matter printed thereon and a pair of downwardly projecting wings 197, each wing 197 being shaped to include a ratchet shaped tooth at its free end. As such, marker 193 is adapted to be slidably mounted onto end cap 177 with a ratchet shaped tooth on each wing 197 projecting within a corresponding slot 191 and engaging top wall 187 to retain marker 193 in place on end cap 177.

Figure 12B:
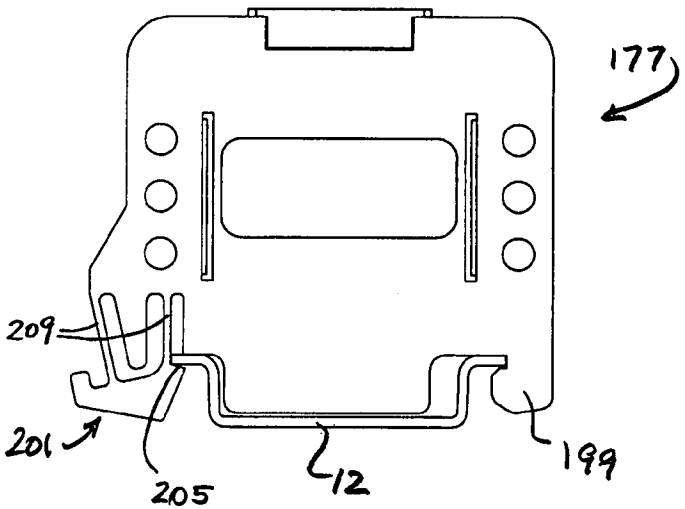
FIGS. 12(*a*) and 12(*b*) are right end plan views of the end cap shown in FIG. 11 at various stages of being mounted onto the DIN rail.
Figure 12A:
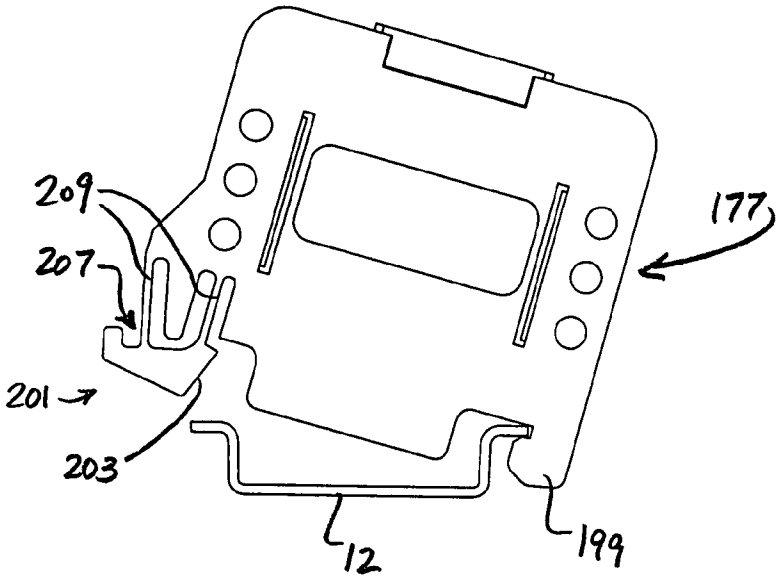

Each end cap 177 is shaped to include a fixed finger 199 and a movable finger 201 which together enable end cap 177 (and, in turn, the remainder of terminal block 11 coupled thereto) to be releasably snap mounted onto DIN rail 12 in the following manner. Specifically, referring now to FIGS. 12(*a*) and 12(*b*), in order to mount end cap 177 onto DIN rail 12, end cap 177 is orientated (i.e., rocked) such that fixed finger 199 engages the underside of DIN rail 12 and such that movable finger 201 is positioned directly above DIN rail 12, as seen most clearly in FIG. 12(*a*). End cap 177 is then rocked downward such that movable finger 201 is drawn into contact against DIN rail 12. A tapered surface 203 on movable finger 201 contacts DIN rail 12 which, in turn, displaces movable finger 201 outward. Continued downward displacement of movable finger 201 eventually causes a shoulder 205 on movable finger 201 to snap engage the underside of DIN rail 12, thereby securing end cap 177 in its mounted position on DIN rail 12, as seen most clearly in FIG. 12(*b*).

Figure 13:
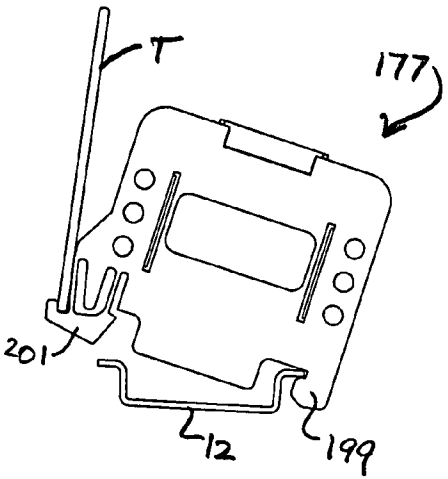
FIGS. 13(*a*)–(*c*) are right end plan views of the end cap shown in FIG. 11 at various stages of being dismounted from the DIN rail.
Figure 13:
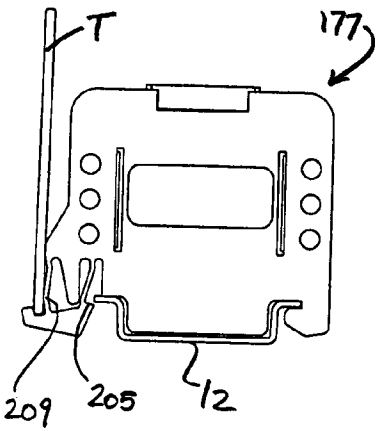
Figure 13:
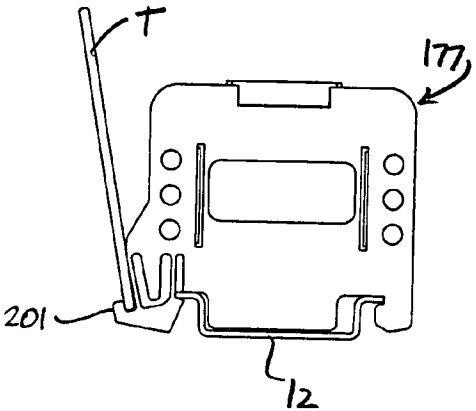

Referring now to FIGS. 13(*a*)–(*c*), in order to dismount end cap 177 from DIN rail 12, a tool T is urged downward into a groove 207 formed in movable finger 201, as shown in FIG. 13(*a*). Movable finger 201 is provided with a pair of thin, flexible support arms 209 which flex, or give, once a suitable down and outward application of force has been applied into groove 207. The bending of support arms 209, in turn, causes shoulder 205 to translate outward and disengage from the underside of DIN rail 12, as shown in FIG. 13(*b*). Movable finger 201 can then be rotated upward so as to completely disengage from DIN rail 12, as seen most clearly in FIG. 13(*c*), which, in turn, enables fixed finger 199 to be slidably removed from DIN rail 12 as well.

With end caps 177 snap mounted on DIN rail 12 in the manner described in detail above, it is to be understood that terminal block 11 is still capable of sliding along the length of DIN rail 12. Accordingly, in order to fix (i.e., lock) the relative position of terminal block 11 in place on DIN rail 12, a DIN rail lock 211 is provided for terminal block 11.

As seen most clearly in FIG. 11, DIN rail lock 211 includes a pin 213 and a bracket 215. Pin 213 comprises a first end 217 which is in the form of a cylindrical post that is slotted at its free end and a second end 219 which is in the form of a threaded screw. Bracket 215 is in the form of a U-shaped member which includes a pair of sharpened engagement teeth 221 at each end. Bracket 215 is additionally shaped to define a threaded bore 223 into which second end 219 of pin 213 can be inserted.

Pin 213 of DIN rail lock 211 is sized and shaped to be longitudinally disposed through an associated bore 51 in mounting block 47 of base 13. In addition, DIN rail lock 211 is adapted to be press-fit mounted against the inner surface of outer end wall 183 for end cap 177, the slotted free end of pin 213 being externally accessible through an arcuate opening 225 formed in top wall 187 of end cap 177. It should be noted that pin 213 of DIN rail lock 211 includes an annular, outwardly projecting flange 227 between first end 217 and second end 219, flange 227 abutting against the underside of a pair of support walls 229 formed in end wall 183 to fix DIN rail lock 211 in place (i.e., to prevent pin 213 from axially sliding within bore 51 in mounting block 47). In this manner, DIN rail lock 211 is connected to both base 13 and end cap 177 at a location along the length of the remainder of terminal block 11 (i.e., at a location inside of outer end wall 183 of both end caps 177), which is highly desirable. As a result, the overall length of terminal block 11 need not be increased to accommodate DIN rail lock 211, which is a principal object of the present invention.

Accordingly, in use, the clockwise rotation of first end 217 of pin 213 (e.g., using a screwdriver) serves to translate bracket 215 downward towards DIN rail 12. The continued clockwise rotation of pin 213 ultimately causes teeth 221 to dig, or bite, into DIN rail 12. In this manner, DIN rail lock 211 serves to fix terminal block 11 in place on DIN rail 12, which is highly desirable.

The versions of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A terminal block for conductively coupling at least one pair of electrical wires, the terminal block comprising:

(a) a non-conductive base, (b) a first conductive bus bar mounted on the base, (c) a second conductive bus bar mounted on the base in a spaced apart relationship from the first bus bar, and (d) a conductive shunt adapted to be disposed between a first position in which said shunt is conductively insulated from at least one of the first and second bus bars and a second position in which said shunt conductively contacts both of the first and second bus bars.

2. The terminal block as claimed in claim 1 further comprising a non-conductive shuttle coupled to the conductive shunt for insulating the conductive shunt from the first and second bus bars when the shunt is disposed in its first position.

3. A terminal block for conductively coupling at least one pair of electrical wires, the terminal block comprising:

(a) a non-conductive base, (b) a first conductive bus bar mounted on the base, (c) a second conductive bus bar mounted on the base in a spaced apart relationship from the first bus bar, (d) a conductive shunt adapted to be disposed into selective common contact with both of the first and second bus bars, and (e) a non-conductive shuttle coupled to the conductive shunt, wherein the shuttle is capable of displacement relative to the shunt between a first position in which the shuttle insulates the shunt from both of the first and second bus bars and a second position in which the shuttle permits the shunt to conductively contact both of the first and second bus bars.

4. The terminal block as claimed in claim 3 wherein the shuttle is adapted to be releasably locked in place in either of its first and second positions.

5. The terminal block as claimed in claim 4 wherein said terminal block further comprises a shunt carrier fixedly mounted onto the shunt.

6. The terminal block as claimed in claim 5 wherein the shuttle is slidably mounted on the shunt carrier.

7. The terminal block as claimed in claim 6 wherein the shunt carrier includes a first recess and a second recess.

8. The terminal block as claimed in claim 7 wherein the shuttle includes a projection, the projection on the shuttle being disposed to ratchet into the first recess in the shunt carrier when the shuttle is disposed in its first position, the projection on the shuttle being disposed to ratchet into the second recess in the shunt carrier when the shuttle is disposed in its second position.

9. The terminal block as claimed in claim 3 further comprising a shunt switch coupled to the shuttle for displacing the shuttle between its first and second positions.

10. The terminal block as claimed in claim 9 wherein the shunt switch includes a handle which is externally accessible.

11. A terminal block for conductively coupling at least one pair of electrical wires, the terminal block comprising:

(a) a non-conductive base, (b) a first conductive bus bar mounted on the base, (c) a second conductive bus bar mounted on the base in a spaced apart relationship from the first bus bar, (d) a conductive shunt adapted to be disposed into selective common contact with both of the first and second bus bars, (e) a spring chamber coupled to the base, and (f) at least one spring coupled at one of its ends to the spring chamber and at the other of its ends to the shunt.

12. The terminal block as claimed in claim 11 wherein the at least one spring resiliently urges the shunt in the direction towards the first and second bus bars.

13. A terminal block for conductively coupling at least one pair of electrical wires, said terminal block comprising:

(a) a non-conductive base, (b) a conductive bus bar mounted on the base, the bus bar being shaped to define a threaded bore, and (c) a cover assembly mounted on the base over the conductive bus bar, the cover assembly comprising, (i) a non-conductive cover comprising a top surface, the cover being shaped to define a bore, and (ii) a captive screw assembly retained within the bore in the cover wherein, the captive screw assembly comprises, (a) a screw disposed within the bore in the cover, and (b) a spring disposed within the bore in the cover for resiliently urging the screw away from the bus bar and in the direction towards the top surface of the cover.

14. The terminal block of claim 13 wherein the conductive bus bar includes a first end and a second end.

15. The terminal block of claim 14 wherein the cover assembly and the base together define first and second wire receiving receptacles.

16. The terminal block of claim 15 wherein the first end of the bus bar is positioned within the first wire receiving receptacle and the second end of the bus bar is positioned within the second wire receiving receptacle.

17. The terminal block of claim 13 wherein the captive screw assembly further comprises a retaining ring coupled to the cover for retaining the screw and the spring within the bore in the cover.

18. The terminal block of claim 17 wherein the spring includes a first end coupled to the screw and a second end coupled to the retaining ring.

19. The terminal block of claim 13 wherein the threaded bore in the bus bar is sized and shaped to receive the screw.

20. The terminal block of claim 13 wherein the cover includes a lip which protrudes into the bore in the cover.

21. The terminal block of claim 20 wherein the lip is sized and shaped to retain the screw recessed beneath the top surface of the cover.

22. A terminal block for conductively coupling at least one pair of electrical wires, the terminal block comprising:

(a) a non-conductive base, (b) a conductive bus bar mounted on the base, (c) an end cap mounted on the base, the end cap being adapted to be mounted on a DIN rail, the end cap having an outer end wall, and (d) a DIN rail lock disposed at a location inside of the outer end wall of the end cap, the DIN rail lock being adapted to selectively engage the DIN rail, wherein the DIN rail lock is coupled to at least one of the base and the end cap, wherein the DIN rail lock comprises:

(i) a pin having a first end and a second end, and (ii) a bracket mounted on the second end of the pin, the bracket comprising at least one sharpened tooth.

23. The terminal block as claimed in claim 22 wherein the pin of the DIN rail lock is engaged by both the non-conductive base and the end cap.

24. The terminal block as claimed in claim 23 wherein rotation of the pin vertically displaces the position of the bracket relative to the pin.

25. The terminal block as claimed in claim 24 wherein the end cap includes a top surface shaped to include an opening so as to render the first end of the pin of the DIN rail lock externally accessible.

26. A terminal block for conductively coupling at least one pair of electrical wires, the terminal block comprising:

(a) a non-conductive base shaped to include a mounting block, (b) a conductive bus bar mounted on the base, and (c) an end cap removably snap-fit mounted on the mounting block of the base, wherein the mounting block on the base includes an outwardly protruding tooth which engages a rib on the end cap to help retain the end cap mounted on the base.

27. The terminal block as claimed in claim 26 wherein the end cap is adapted to receive a latching lug.

28. The terminal block as claimed in claim 27 wherein the end cap is adapted to receive a marker.

* * * * *